US008985978B2

(12) United States Patent
Nakai et al.

(10) Patent No.: US 8,985,978 B2
(45) Date of Patent: Mar. 24, 2015

(54) SCROLL COMPRESSOR WITH BYPASS HOLES

(75) Inventors: Hiroaki Nakai, Shiga (JP); Hirofumi Yoshida, Shiga (JP); Tsuyoshi Karino, Shiga (JP); Ryuichi Ohno, Shiga (JP); Shingo Oyagi, Kyoto (JP); Noboru Iida, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 69 days.

(21) Appl. No.: 13/808,193

(22) PCT Filed: Jul. 7, 2011

(86) PCT No.: PCT/JP2011/003913

§ 371 (c)(1),
(2), (4) Date: Jan. 3, 2013

(87) PCT Pub. No.: WO2012/005007

PCT Pub. Date: Jan. 12, 2012

(65) Prior Publication Data

US 2013/0108496 A1 May 2, 2013

(30) Foreign Application Priority Data

Jul. 8, 2010 (JP) ..... 2010-155638

(51) Int. Cl.
*F04C 28/26* (2006.01)
*F04C 18/02* (2006.01)
(Continued)

(52) U.S. Cl.
CPC ..... *F04C 28/26* (2013.01); *F04C 18/0215* (2013.01); *F04C 18/0261* (2013.01); *F04C 29/128* (2013.01); *F04C 2210/26* (2013.01);
(Continued)

(58) Field of Classification Search
CPC ..... F04C 18/0261; F04C 28/26
See application file for complete search history.

(56) References Cited

U.S. PATENT DOCUMENTS 4,818,195 A * 4/1989 Murayama et al. ..... 418/15
5,674,058 A * 10/1997 Matsuda et al. ..... 417/440
5,855,475 A * 1/1999 Fujio et al. ..... 418/15
(Continued)

FOREIGN PATENT DOCUMENTS

CN 1247598 3/2000
JP 58-128485 8/1983
(Continued)

*Primary Examiner* — Thomas Denion
*Assistant Examiner* — Xiaoting Hu
(74) *Attorney, Agent, or Firm* — Hamre, Schumann, Mueller & Larson, P.C.

(57) ABSTRACT

A scroll compressor employs therein a refrigerant having a small global warming potential and a small ozone depletion potential and mainly comprising hydrofluoroolefin having a carbon-carbon double bond. A stationary scroll has and end plate and a discharge port defined in the end plate at a central portion thereof so as to open into a discharge chamber. The stationary scroll also has a bypass hole defined in the end plate to allow a plurality of compression chambers to communicate with the discharge chamber before the compression chambers communicate with the discharge port. A check valve is provided on the bypass hole to allow the refrigerant to flow from the compression chambers to the discharge chamber. This construction can restrain a baneful influence on the global environment, reduce a temperature increase caused by excessive compression, and restrain decomposition of the refrigerant even in long-term use.

7 Claims, 7 Drawing Sheets

(51) Int. Cl.
*F04C 29/12* (2006.01)
*F04C 23/00* (2006.01)

(52) U.S. Cl.
CPC ..... *F04C 2210/263* (2013.01); *F04C 23/008* (2013.01)
USPC ..... 418/55.1; 418/55.2

(56) References Cited

U.S. PATENT DOCUMENTS

| | | | | |
|---|---|---|---|---|
| 6,571,575 | B1 | 6/2003 | Fujitaka et al. | |
| 2001/0037649 | A1 | 11/2001 | Fujitaka et al. | |
| 2006/0057010 | A1* | 3/2006 | Tsubono et al. | 418/55.5 |
| 2006/0093504 | A1* | 5/2006 | Kim et al. | 418/55.1 |
| 2010/0221133 | A1* | 9/2010 | Nishikawa et al. | 418/55.1 |
| 2010/0303659 | A1* | 12/2010 | Stover et al. | 418/24 |
| 2011/0011124 | A1* | 1/2011 | Matsuura et al. | 62/468 |

FOREIGN PATENT DOCUMENTS

| | | |
|---|---|---|
| JP | 5-49830 | 7/1993 |
| JP | 7-253254 | 10/1995 |
| JP | 11-316067 | 11/1999 |
| JP | 2008-286095 | 11/2008 |
| JP | 2009-228471 | 10/2009 |
| WO | WO 2009/116282 | 9/2009 |

* cited by examiner

*Fig. 7* -- Prior Art --
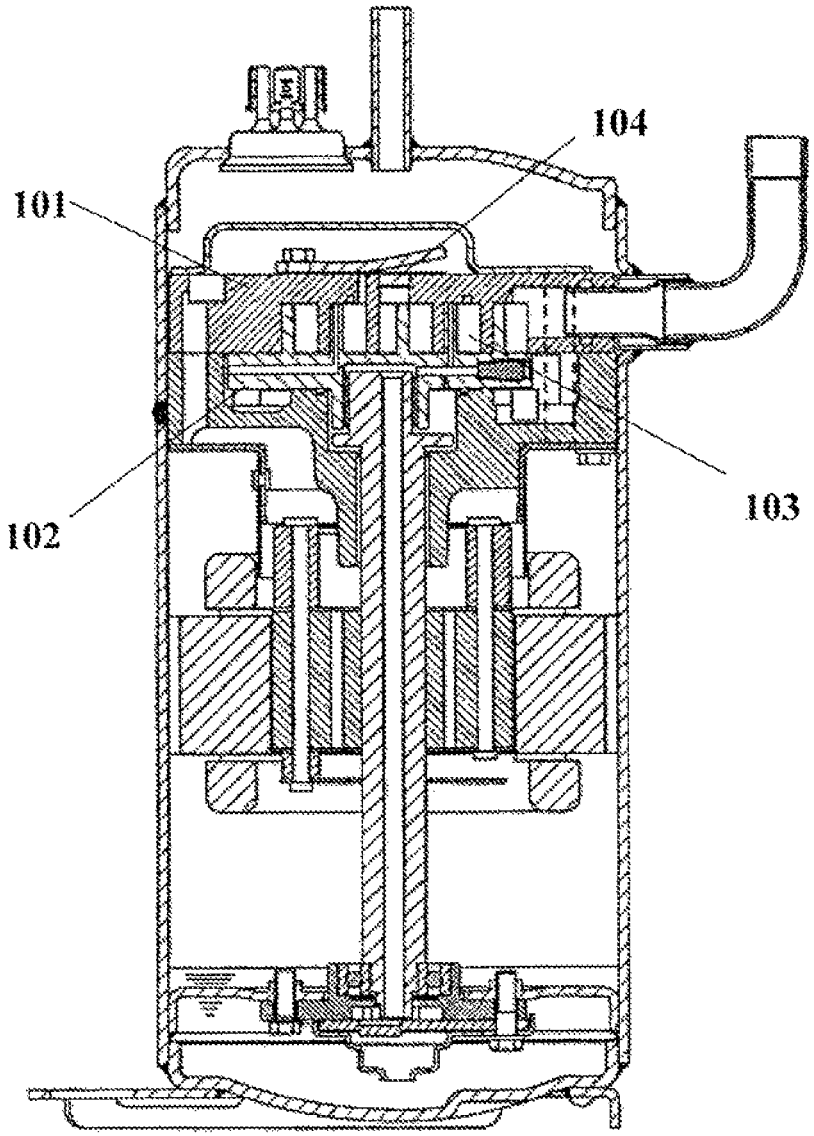

SCROLL COMPRESSOR WITH BYPASS HOLES

TECHNICAL FIELD

The present invention relates to a scroll compressor that can be incorporated into refrigerating cycles such as, for example, room-air conditioners, car-air conditioners, refrigerators or other air conditioners in which a refrigerant containing no chlorine atoms, having a small global warming potential, and mainly comprising hydrofluoroolefin having a carbon-carbon double bond is employed as a refrigerant.

BACKGROUND ART

Conventional refrigerating appliances generally employ an HFC (hydrofluorocarbon) refrigerant having a zero-ozone depletion potential as a refrigerant, but in recent years the use of the HFC refrigerant becomes a problem because it has a very large global warming potential. In view of this, a compressor for use with a refrigerant having a small ozone depletion potential and a small global warming potential has been developed. However, the refrigerant having a small global warming potential generally shows poor stability and has a problem in stability and reliability when used in refrigerating cycles such as, for example, room-air conditioners, car-air conditioners, refrigerators or other air conditioners, all of which are predicated on long-term use.

On the other hand, in the refrigerating cycle, the compressor acts to inhale a gas refrigerant vaporized in an evaporator and compress it to a predetermined pressure and, hence, in order to ensure the stability and reliability of the refrigerant, a state of which greatly varies from a low pressure to a high pressure and from a low temperature to a high temperature, sufficient measures must be taken for the compressor.

As shown in FIG. 7, a conventional scroll compressor has a plurality of compression chambers 103 defined between a stationary scroll 101 and an orbiting scroll 102, and an inhaled refrigerant is compressed, utilizing the fact that the compression chambers 103 move while reducing a volume thereof. The refrigerant compressed to a predetermined pressure is discharged to a discharge chamber through a discharge port 104 defined in an end plate of the stationary scroll 101 at a central portion thereof.

In the scroll compressor of the above-described construction, the pressure the compression chambers 103 always undergoes a given process based on a suction pressure and a volumetric change of the compression chambers 103, irrespective of a discharge pressure. Because of this, an excessive pressure increase occurs depending on the timing at which the discharge port 104 communicates with the compression chambers 103 and causes unstable behaviors of the orbiting scroll 102, in which the orbiting scroll 102 is separated from the stationary scroll 101 or conversely, an abnormal pressure acts on the orbiting scroll 102.

In a scroll compressor having symmetrical compression chambers that has been developed to solve this kind of problem, communication holes are provided to respectively communicate the compression chambers in the middle of compression with a rear side of the stationary scroll and with a rear side of the orbiting scroll, and these communication holes leading to the rear sides are located on a central side relative to a communication hole leading to a discharge side, thereby always applying an appropriate pressure to the orbiting scroll (see, for example, Patent Document 1).

PATENT DOCUMENT(S)

Patent Document 1: JP 5-49830 B2

SUMMARY OF INVENTION

Problems to be solved by the Invention

However, in the above-described conventional refrigerating appliances, the use of a refrigerant containing no chlorine atoms, having a small global warming potential, and mainly comprising hydrofluoroolefin having a carbon-carbon double bond poses the following problems. That is, the refrigerant containing no chlorine atoms, having a small global warming potential, and mainly composed of hydrofluoroolefin having a carbon-carbon double bond is likely to decompose at high temperatures and, hence, this refrigerant decomposes with an increase in discharge temperature caused by excessive compression or re-expansion, thus resulting in a reduction in stability. In particular, in room-air conditioners, car-air conditioners, refrigerators, other air conditioners or the like, all of which are used for long periods, decomposition caused by a temperature increase is accumulated over a long period of time and, accordingly, countermeasures against the temperature increase are particularly important.

The present invention has been developed to solve the above-described problem and is intended to provide a scroll compressor that employs a refrigerant having a small global warming potential as a refrigerant, can curb an increase in temperature of a discharged refrigerant caused by excessive compression, and is superior in efficiency, reliability and durability.

Means to Solve the Problems

In order to solve the above-described problem inherent in the prior art, the scroll compressor according to the present invention employs therein a refrigerant containing no chlorine atoms, having a small global warming potential, and mainly comprising hydrofluoroolefin having a carbon-carbon double bond as a refrigerant. The scroll compressor according to the present invention has a bypass hole defined in an end plate of a stationary scroll to allow a plurality of compression chambers to communicate with a discharge chamber before the compression chambers communicate with a discharge port. A check valve is provided on the bypass hole to allow the refrigerant to flow from the compression chambers to the discharge chamber.

This construction can restrain a temperature increase that may be caused by excessive compression of the refrigerant immediately before the refrigerant is discharged from the discharge port, thereby making it possible to restrain decomposition of the refrigerant.

Effects of the Invention

The scroll compressor according to the present invention employs therein a refrigerant having a small global warming potential and a small ozone depletion potential and can restrain a temperature increase of the refrigerant leading to promotion of decomposition of the refrigerant. Accordingly, an improved scroll compressor can be provided that is superior in efficiency, reliability and durability while attending to the global environment.

BRIEF DESCRIPTION OF THE DRAWINGS

The above construction and features of the present invention will become apparent from the following description of preferred embodiments thereof with reference to the accompanying drawings, wherein:

FIG. 7 is a sectional view of a conventional scroll compressor.

DESCRIPTION OF EMBODIMENTS

Figure 1:
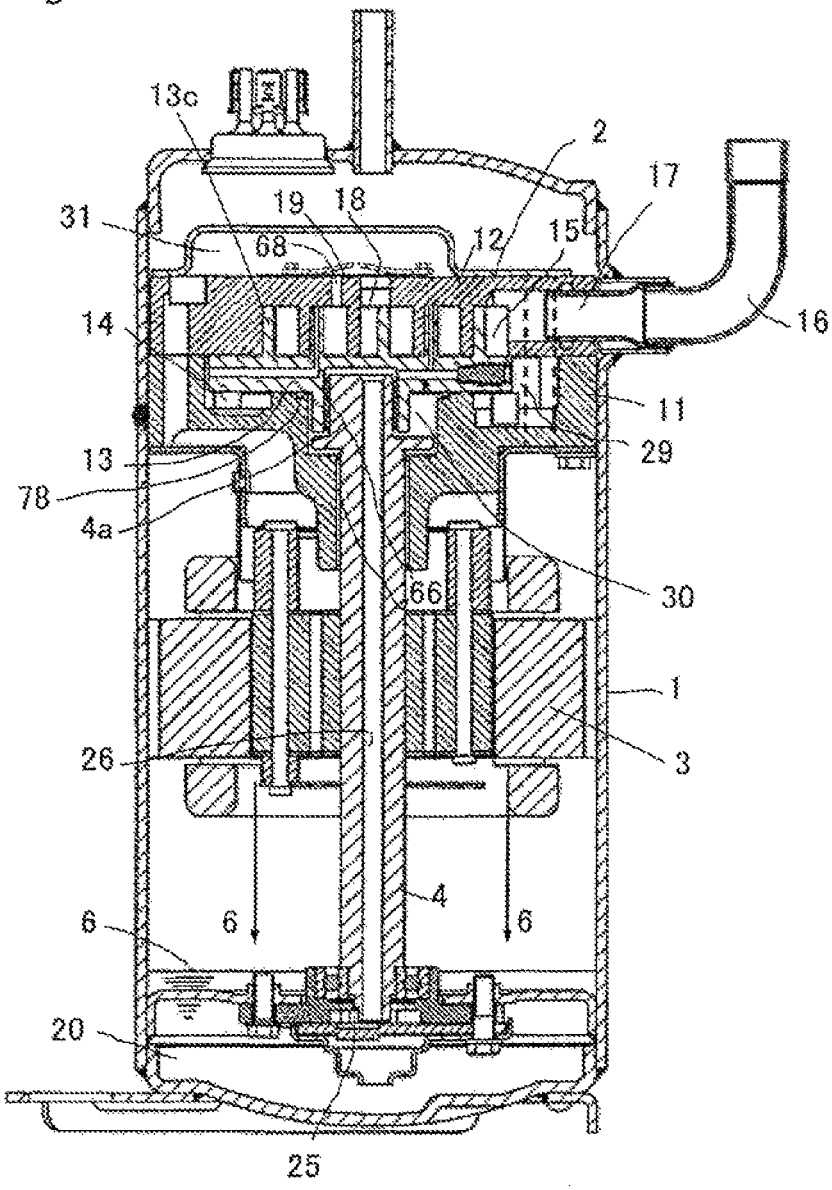
FIG. 1 is a sectional view of a scroll compressor according to a first embodiment of the present invention.

A first invention is directed to a scroll compressor that employs therein a single-component refrigerant mainly comprising hydrofluoroolefin having a carbon-carbon double bond or a mixture refrigerant containing this refrigerant. This scroll compressor includes a stationary scroll having a stationary end plate and a stationary scroll wrap rising up from the stationary end plate. The stationary end plate has a discharge port defined therein at a central portion thereof so as to open into a discharge chamber. The scroll compressor also includes an orbiting scroll having an orbiting end plate and an orbiting scroll wrap rising up from the orbiting end plate. The orbiting scroll is held in engagement with the stationary scroll to define a plurality of compression chambers therebetween. The stationary end plate also has a bypass hole defined therein to allow the compression chambers to communicate with the discharge chamber before the compression chambers communicate with the discharge port. A check valve is provided on the bypass hole to allow the refrigerant to flow from the compression chambers to the discharge chamber. According to this construction, the use of a refrigerant having a small global warming potential and a small ozone depletion potential as a refrigerant restrains a baneful influence on the global environment and, also, although the refrigerant is likely to decompose at high temperatures, the provision of the bypass hole can restrain a temperature increase caused by excessive compression and minimize decomposition of the refrigerant even in long-term use.

In the scroll compressor according to the first invention, a second invention is such that a plurality of bypass holes are provided to communicate with the compression chambers over a wide range. Also, an increase in total effective flow passage area can reduce a resistance to flow of each bypass hole, this making it possible to assuredly restrain a temperature increase caused by excessive compression.

In the scroll compressor according to the first or second invention, a third invention is such that at least one of the bypass holes is a circular communication hole. The circular shape minimizes a ratio of the resistance to flow to the area of the bypass holes, thereby further reducing a temperature increase caused by excessive compression.

In the scroll compressor according to any one of the first to third inventions, a fourth invention is such that at least one of the bypass holes is formed at a position that allows the at least one bypass hole to open into only one of a first compression chamber formed on an outer side of the orbiting scroll wrap and a second compression chamber formed on an inner side of the orbiting scroll wrap. Such a position is an optimum position where the refrigerant in each compression chamber opens the check valve on the bypass hole when the refrigerant has reached a discharge pressure, thus making it possible to minimize a temperature increase caused by excessive compression.

In the scroll compressor according to any one of the first to fourth inventions, a fifth invention is such that at least one of the bypass holes is formed at a position that allows the at least one bypass hole to open into both of a first compression chamber formed on an outer side of the orbiting scroll wrap and a second compression chamber formed on an inner side of the orbiting scroll wrap, the at least one bypass hole having a shape and a size that do not allow the at least one bypass hole to simultaneously open into the first compression chamber and the second compression chamber. If the first and second compression chambers communicate with each other via the bypass holes, a pressure difference between them causes re-expansion of the refrigerant to thereby cause a temperature increase in the compression chambers, but the-above described configuration can avoid such a phenomenon.

In the scroll compressor according to any one of the first to fifth inventions, a sixth invention is such that the check valve is made up of a reed valve mounted on a surface of the stationary end plate. Compared with a check valve having, for example, a spring within a bypass hole, the reed valve acts to restrain a resistance to flow to thereby reduce a temperature increase caused by excessive compression.

In the first to sixth inventions, a seventh invention is characterized in that a refrigerant mainly comprising hydrofluoroolefin having a carbon-carbon double bond or a mixture refrigerant containing this refrigerant and mixed with hydrofluorocarbon having no double bonds is used. The use of such a refrigerant can effectively provide a highly-reliable and highly-efficient scroll compressor.

In the first to sixth inventions, an eighth invention is characterized in that a mixture refrigerant comprising tetrafluoropropene or trifluoropropene as a hydrofluoroolefin and difluoromethane as a hydrofluorocarbon is used. This feature can reduce a circulation volume of the refrigerant in a refrigerating cycle to thereby restrain excessive compression caused by a pressure loss, thus making it possible to effectively provide a highly-reliable and highly-efficient scroll compressor.

In the scroll compressor according to any one of the first to sixth inventions, a ninth invention is characterized in that a mixture refrigerant comprising tetrafluoropropene or trifluoropropene as a hydrofluoroolefin and, pentafluoroethane as a hydrofluorocarbon is used. This feature can reduce a discharge temperature of the compressor in a refrigerating cycle, thus making it possible to effectively provide a highly-reliable and highly efficient scroll compressor.

In the scroll compressor according to any one of the first to ninth inventions, a tenth invention is characterized in that at least one of the bypass holes has a diameter D, the stationary end plate has a length L in a thickness direction, and a ratio D/L ranges from 2.4 to 7.2. This feature can optimize a ratio of a pressure loss of the refrigerant passing thorough the bypass holes to a loss caused by re-expansion of the refrigerant within the bypass holes, thus making it possible to provide a highly-efficient scroll compressor that can restrain a temperature increase within the compression chambers.

Embodiments of the present invention are described hereinafter with reference to the drawings, but the present invention is not limited to the embodiments.

Embodiment 1

Figure 2:
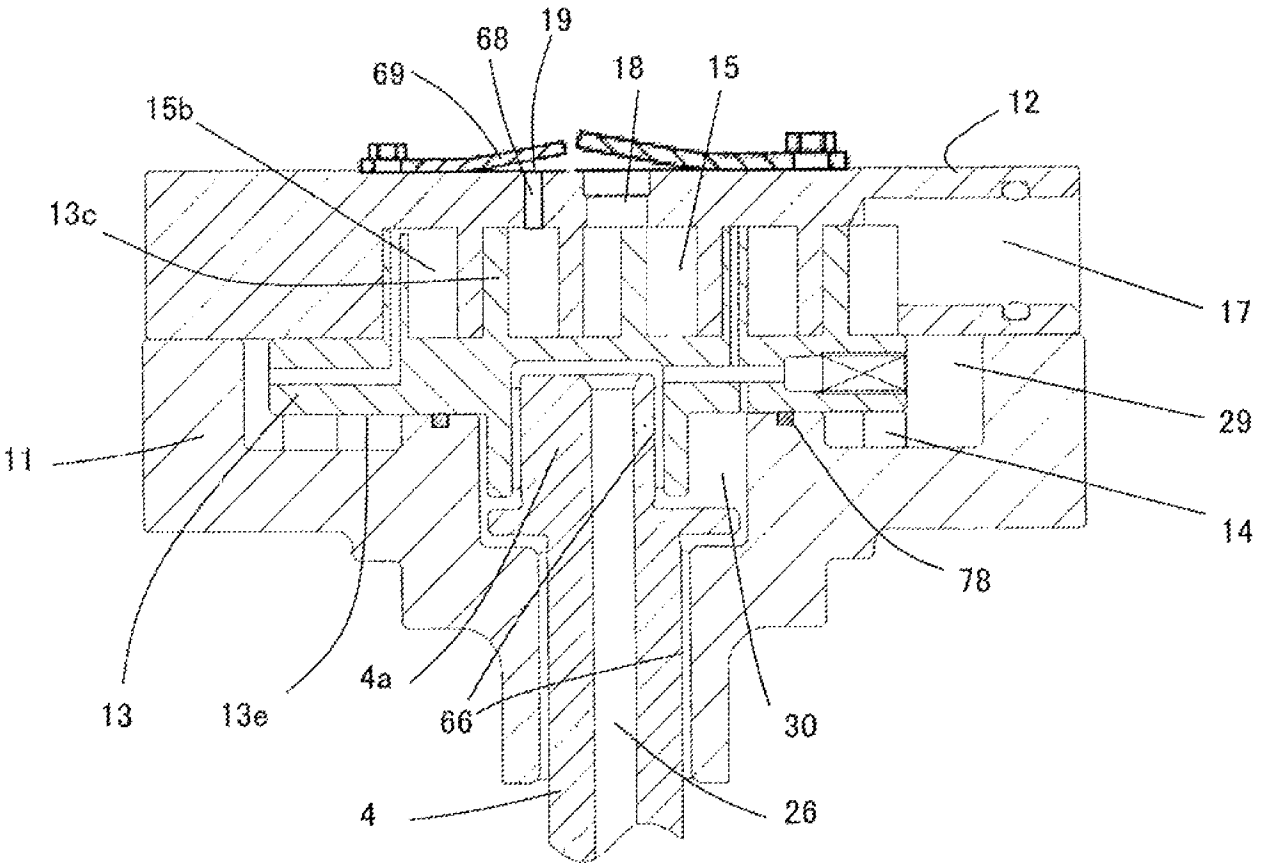
FIG. 2 is an enlarged sectional view of an essential portion of a compression mechanism mounted in the scroll compressor according to the first embodiment.
Figure 3:
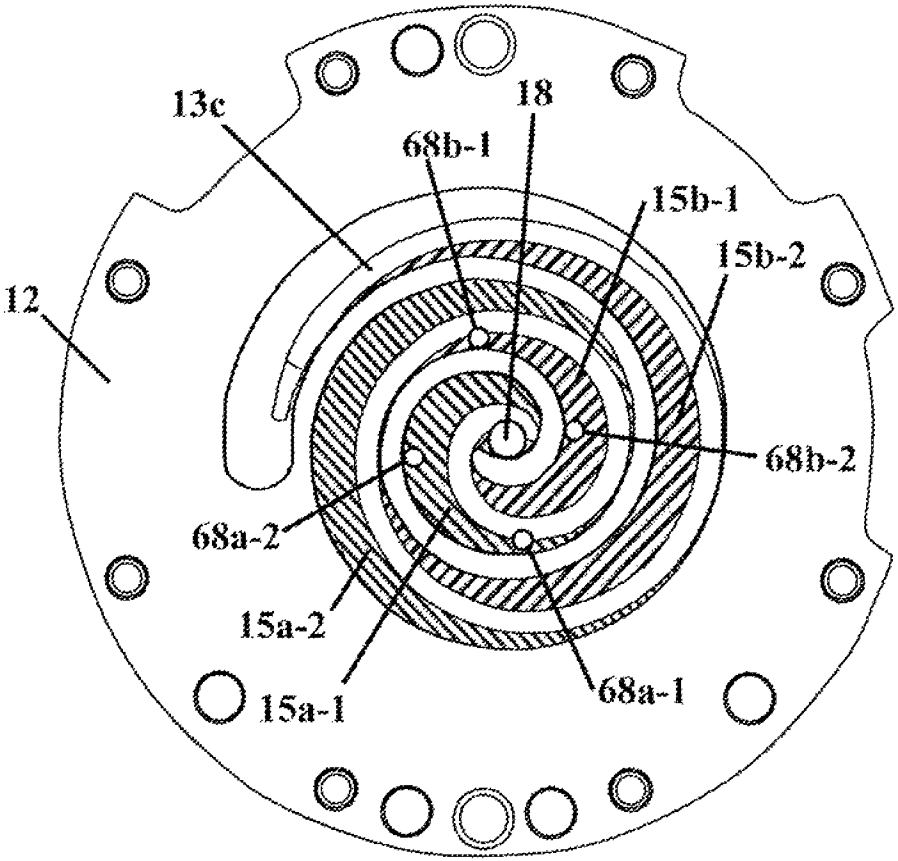
FIG. 3 is a top plan view of an orbiting scroll mounted in the scroll compressor according to the first embodiment.

In the present invention, a single-component refrigerant mainly comprising hydrofluoroolefin having a carbon-carbon double bond or a mixture refrigerant containing this refrigerant is used as a refrigerant FIG. 1 is a vertical sectional view of a scroll compressor according to a first embodiment of the present invention. FIG. 2 is an enlarged sectional view of an essential portion of a compression mechanism mounted in the scroll compressor of FIG. 1, and FIG. 3 is a top plan view of the compression mechanism. Operation and function of the scroll compressor are explained hereinafter.

As shown in FIG. 1, the scroll compressor according to the first embodiment of the present invention includes a dosed container 1, in which a compression mechanism 2, an electric motor 3 and an oil sump 20 are accommodated. Details of the compression mechanism 2 are explained with reference to FIG. 2. The closed container 1 accommodates a main bearing 11 secured thereto by welding or shrink fitting, a shaft 4 journaled in the main bearing 11, a stationary scroll 12 bolted to the main bearing 11, and an orbiting scroll 13 interposed between the main bearing 11 and the stationary scroll 12 and held in engagement with the stationary scroll 12. A rotation constraint mechanism 14 including, for example, an Oldham's ring for preventing rotation of the orbiting scroll 13 about its own axis, but allowing the orbiting scroll 13 to travel on a circular orbit is provided between the orbiting scroll 13 and the main bearing 11. The shaft 4 has an eccentric shaft 4*a* formed therewith at an upper portion thereof, eccentric rotation of which drives the orbiting scroll 13 to travel on the circular orbit. Each of the stationary scroll 12 and the orbiting scroll 13 is of a construction having an end plate and a scroll wrap rising up (protruding) from the end plate.

A plurality of compression chambers 15 are formed between the stationary scroll 12 and the orbiting scroll 13 and move from an outer peripheral side toward a central portion while reducing a volume thereof to inhale a refrigerant therein through a suction pipe 16 leading to the outside of the closed container 1 and through a suction port 17 defined in the stationary scroll 12 at an outer periphery thereof. The refrigerant so inhaled is trapped within the compression chambers 15 for compression. When the refrigerant reaches a predetermined pressure, the refrigerant passes through a through-hole or discharge port 18 defined in the stationary scroll 12 at a central portion thereof (central position of the end plate) and through a plurality of through-holes or circular bypass holes 68 defined in the end plate of the stationary scroll 12 at positions different from the discharge port 18 and opens a reed valve (check valve) 19 before the refrigerant is discharged into the closed container 1. A valve stopper 69 for controlling a lift of the reed valve 19 is provided to avoid damage of the reed valve 19 that may be caused by excessive deformation thereof. The reed valve 19 is mounted on, for example, a surface of the end plate of the stationary scroll 12 at a position where the bypass holes 68 are formed.

A pump 25 is mounted on a lower end of the shaft 4 and has a suction opening positioned inside the oil sump 20. Because the pump 25 is driven in synchronization with the scroll compressor, the pump 25 can assuredly suck up oil 6 in the oil sump 20 formed at a bottom portion of the closed container 1, irrespective of pressure conditions or a running speed, thereby eliminating lack of oil. The oil 6 sucked up by the pump 25 is supplied to the compression mechanism 2 through an oil supply hole 26 defined in the shaft 4 so as to extend therethrough. If foreign substances in the oil 6 are removed by, for example, an oil filter before the oil 6 is sucked up by the pump 6 or after the former has been sucked up by the latter, entry of the foreign substances into the compression mechanism 2 can be prevented, thus making it possible to further enhance the reliability.

The oil 6 introduced into the compression mechanism 2 has a pressure substantially equal to that of a refrigerant discharged from the scroll compressor and becomes a source of back pressure with respect to the orbiting scroll 13. Accordingly, the orbiting scroll 13 is prevented from moving away from the stationary scroll 12 or from being disproportionately held in partial contact with the stationary scroll 12 and stably fulfills a predetermined compression function. Further, part of the oil 6 is supplied to or escapes to a mating portion between the eccentric shaft 4*a* and the orbiting scroll 13 and to a bearing bush 66 between the shat 4 and the main bearing 11 by a supply pressure or under its own weight to lubricate respective portions. After lubrication, the oil 6 drops and returns to the oil sump 20.

A sealing member 78 is disposed on a rear surface 13*e* of the end plate of the orbiting scroll 13 to partition a rear side of the end plate into a high-pressure region 30 located inside the sealing member 78 and a back pressure chamber 29 located outside the sealing member 78. Because the sealing member 78 acts to completely separate between a pressure in the high-pressure region 30 and a pressure in the back pressure chamber 29, it becomes possible to stably control a pressure load on the rear surface 13*e* of the orbiting scroll 13.

Figure 4:
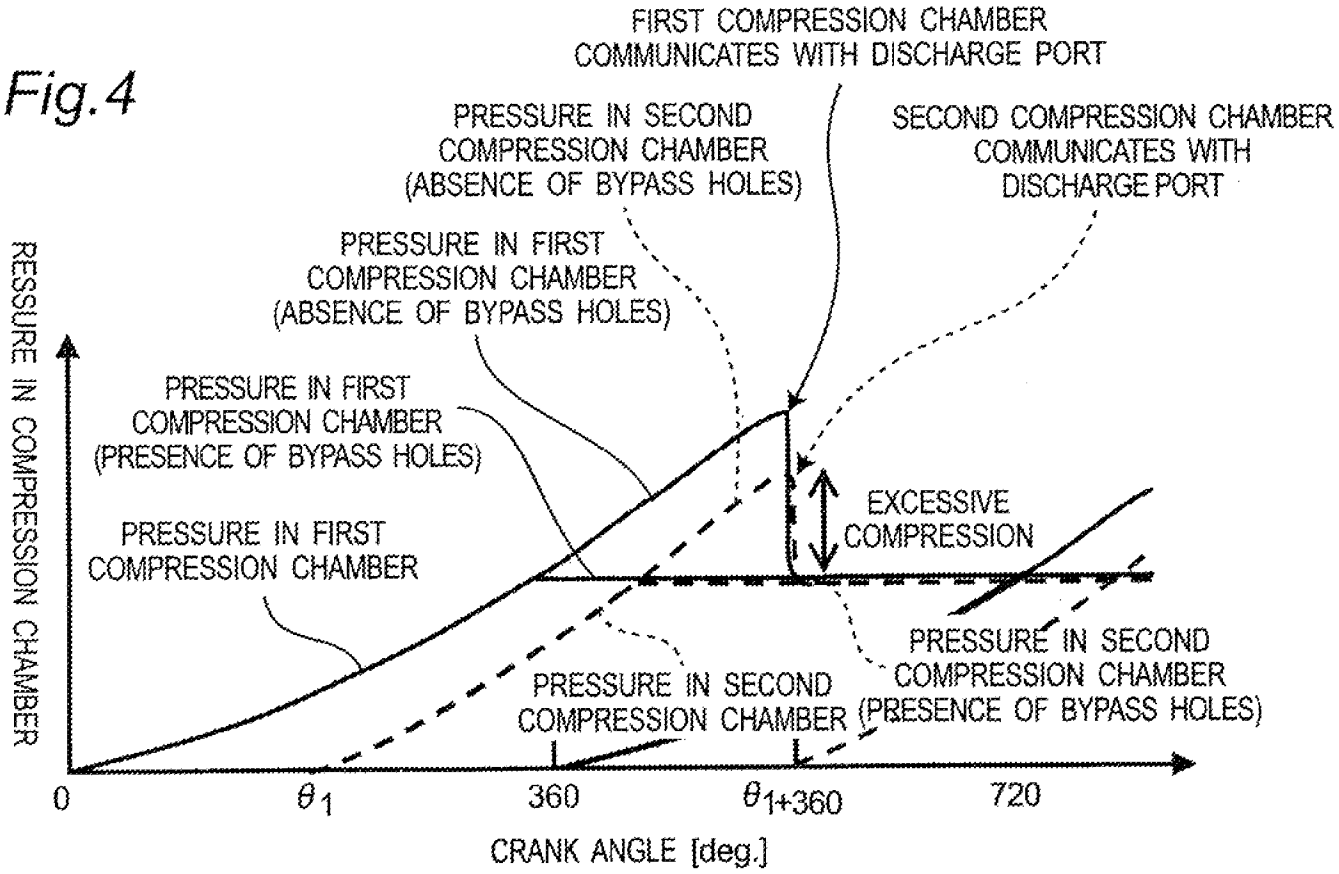
FIG. 4 is a comparative graph indicating pressures in compression chambers in the first embodiment of the present invention and in a comparative example.

A pressure increase in the compression chambers 15 formed by the stationary scroll 12 and the orbiting scroll 13 is explained hereinafter with reference to FIG. 3. The compression chambers 15 formed by the stationary scroll 12 and the orbiting scroll 13 include a plurality of first compression chambers 15*a*-1, 15*a*-2 formed on an outer side of the scroll wrap of the orbiting scroll 13 and a plurality of second compression chambers 15*b*-1, 15*b*-2 formed on an inner side of the scroll wrap of the orbiting scroll 13. The respective compression chambers 15 move toward a center while reducing a volume thereof with an orbital movement of the orbiting scroll 13. When the compression chambers 15 reach a discharge pressure and communicate with the discharge port 18 or the bypass holes 68*a*-1, 68*a*-2, 68*b*-1, 68*b*-2, a refrigerant in the compression chambers opens the reed valve 19 and is discharged into a discharge chamber 31. FIG. 4 depicts a comparison of the pressure in the compression chambers between a case where the bypass holes 68*a*-1, 68*a*-2, 68*b*-1, 68*b*-2 are provided (first embodiment) and a case where no bypass holes are provided (comparative example). If the bypass holes 68*a*-1, 68*a*-2, 68*b*-1, 68*b*-2 are not provided, the pressure in the compression chambers 15 continues to increase until the compression chambers 15 communicate with the discharge port 18 and, hence, the pressure in the compression chambers 15 increases over the discharge pressure in the discharge chamber 31, which may increase a discharge temperature more than necessary.

In view of the foregoing, in the first embodiment, the bypass holes 68*a*-1, 68*a*-2, 68*b*-1, 68*b*-2 are provided at positions where they communicate respectively with the compression chambers 15 earlier (at the earlier timing) than the discharge port 18 does. Thereby, when the pressure inside the compression chambers 15 reaches the discharge pressure, discharge of the refrigerant into the discharge chamber 31 is initiated through the bypass holes 68*a*-1, 68*a*-2, 68*b*-1, 68*b*-2, thereby avoiding an increase in discharge temperature caused by an excessive pressure increase. Because the bypass holes 68*a*-1, 68*a*-2, 68*b*-1, 68*b*-2 are all formed into a circular communication hole, a resistance to flow is minimized compared with other shapes having the same area as that of the bypass holes 68*a*-1, 68*a*-2, 68*b*-1, 68*b*-2. Further, as shown in FIG. 4, crank angles at which the first compression chambers 15*a*-1, 15*a*-2 and the second compression chambers 15*b*-1, 15*b*-2 reach the discharge pressure differ and, hence, in the present invention the bypass holes 68*a*-1, 68*a*-2, 68*b*-1, 68*b*-2 are appropriately positioned such that the bypass holes 68*a*-1, 68*a*-2 communicate with only the first compression chambers 15*a*-1, 15*a*-2 and the bypass holes 68*b*-1, 68*b*-2 communicate with only the second compression chambers 15*b*-1, 15*b*-2, thus making it possible to control an increase in discharge temperature of the refrigerant employed in the present invention that is likely decompose with an increase in temperature.

Embodiment 2

Figure 5:
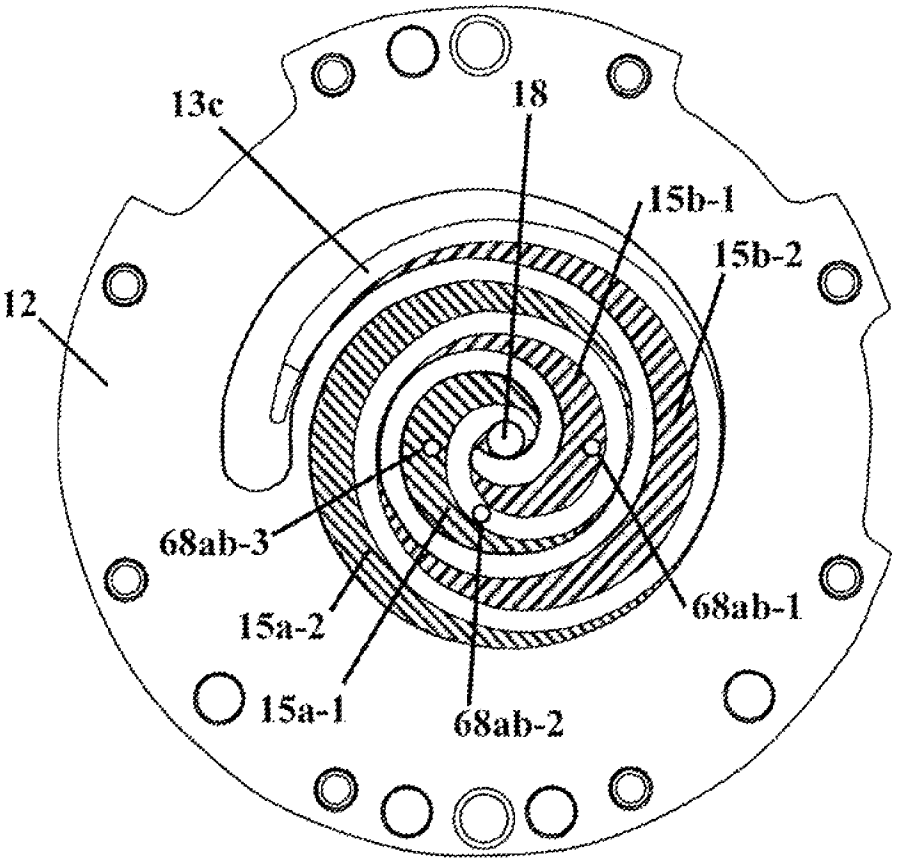
FIG. 5 is a top plan view of an orbiting scroll mounted in a scroll compressor according to a second embodiment of the present invention.

FIG. 5 is a top plan view of a compression mechanism mounted in a scroll compressor according to a second embodiment of the present invention. Because the configuration other than bypass holes 68*ab* is the same as that in the first embodiment, the same component parts as those shown in FIG. 3 are designated by the same signs in FIG. 5, only the bypass holes 68*ab* are explained and explanation of the rest is omitted.

As shown in FIG. 5, in the scroll compressor according to the second embodiment, the bypass holes 68*ab* are provided at positions where they communicate with the first compression chamber 15*a* and the second compression chamber 15*b*, but any one of them does not simultaneously open into the first compression chamber 15*a* and the second compression chamber 15*b* with an orbital movement of the orbiting scroll 13. To this end, the bypass holes 68*ab* have a diameter smaller than a thickness of an orbiting scroll wrap 13*c*. At a crank angle shown in FIG. 5, the bypass hole 68*ab*-1 communicates with the second compression chamber 15*b*-1 and the bypass hole 68*ab*-3 communicates with the first compression chamber 15*a*-1 to avoid excessive compression, and when the orbiting scroll wrap 13*c* is located on one of the bypass holes as with the bypass hole 68*ab*-2, the one of the bypass holes 68*ab* communicates with neither the first compression chamber 15*a*-1 nor the second compression chamber 15*b*-1. This configuration does not cause any leakage of the refrigerant between the compression chambers and controls an increase in discharge temperature of the refrigerant employed in the present invention that is likely decompose with an increase in temperature.

It is to be noted here that although in the first and second embodiments a single-component refrigerant mainly comprising hydrofluoroolefin having a carbon-carbon double bond or a mixture refrigerant containing this refrigerant is used as a refrigerant, a refrigerant mainly comprising hydrofluoroolefin having a carbon-carbon double bond and mixed with hydrofluorocarbon having no double bonds may be used as the refrigerant.

Also, a mixture refrigerant comprising tetrafluoropropene (HFO1234yf or HFO1234ze) or trifluoropropene (HFO1243zf) as a hydrofluoroolefin and difluoromethane (HFC32) as a hydrofluorocarbon may be used as the refrigerant.

Further, a mixture refrigerant comprising tetrafluoropropene (HFO1234yf or HFO1234ze) or trifluoropropene (HFO1243zf) as a hydrofluoroolefin and pentafluoroethane (HFC125) as a hydrofluorocarbon may be used as the refrigerant.

In addition, a three-component mixture refrigerant comprising tetrafluoropropene (HFO1234yf or HFO1234ze) or trifluoropropene (HFO1243zf) as a hydrofluoroolefin and of pentafluoroethane (HFC125) and difluoromethane (HFC32) as hydrofluorocarbons may be used as the refrigerant.

In each case, the use of a two- or three-component refrigerant is preferable in which two or three components are mixed so as to make the global warming potential greater than or equal to 5 and less than or equal to 750, preferably less than or equal to 350.

As a refrigerant oil for use with the above-described refrigerants, the use of a synthetic of mainly comprising an oxygenated compound such as, for example, polyoxyalkylene glycols, polyvinyl ethers, copolymers of poly(oxy)alkylene glycol or mono ether thereof and polyvinyl ether, polyol esthers, and polycarbonates is preferred. The use of a synthetic oil mainly comprising one of alkyl benzenes and alpha olefins is also preferred.

If the bypass holes 68 are small in diameter D or large in length L, a pressure loss of the refrigerant passing through the bypass holes 68 becomes large and, hence, a ratio D/L of the diameter D to the length L must be greater than a certain value in terms of the pressure loss. On the other hand, a volume V of the bypass holes 68 is proportional to the length L and if the bypass holes 68 are circular, the volume V is proportional to a square of the diameter D. However, a re-expansion loss caused by re-expansion of the refrigerant within the bypass holes 68 becomes large with an increase in volume V. Accordingly, it is preferred that a product of the square of the diameter D and the length L be as small as possible. From the foregoing, an optimum range is determined based on a relationship between the pressure loss and the re-expansion loss.

On the other hand, the length L of the bypass holes 68 is associated with a thickness of the end plate of the stationary scroll 12. The end plate of the stationary scroll 12 must have a thickness that can maintain a sufficient rigidity to keep deformation of the stationary scroll 12 within an allowable range in the presence of a pressure difference between a high pressure and a low pressure of the refrigerant to be compressed. An amount of deformation caused by the pressure difference is proportional to the pressure difference and inversely proportional to a cube of the thickness of the end plate.

When the refrigerant employed in the present invention is compared with an R410A refrigerant, the pressure of the former is reduced to about 40% and, accordingly, the thickness of the end plate can be reduced to about 75% of that of a conventional compressor designed for the R410A refrigerant. That is, the length L of the bypass holes 68 can be similarly reduced to about 75%.

When the refrigerant employed in the present invention is again compared with the R410A refrigerant, a density of the refrigerant employed in the present invention reduces to about 40% in the same performance. That is, if a suction volume of the compressor is determined to fulfill the same performance, the volume V of the bypass holes 68 can be increased to equalize the influence of the re-expansion loss thereof. Accordingly, even if the volume V is increased to 250% in the case of the refrigerant of the present invention, the re-expansion loss is the same in the same performance.

From the above, when the length L of the bypass holes 68 is reduced to 75% and the volume V of the bypass holes 68 is increased to 250%, even if the diameter D of the bypass holes 68 is increased to 180%, the re-expansion loss becomes the same.

Figure 6:
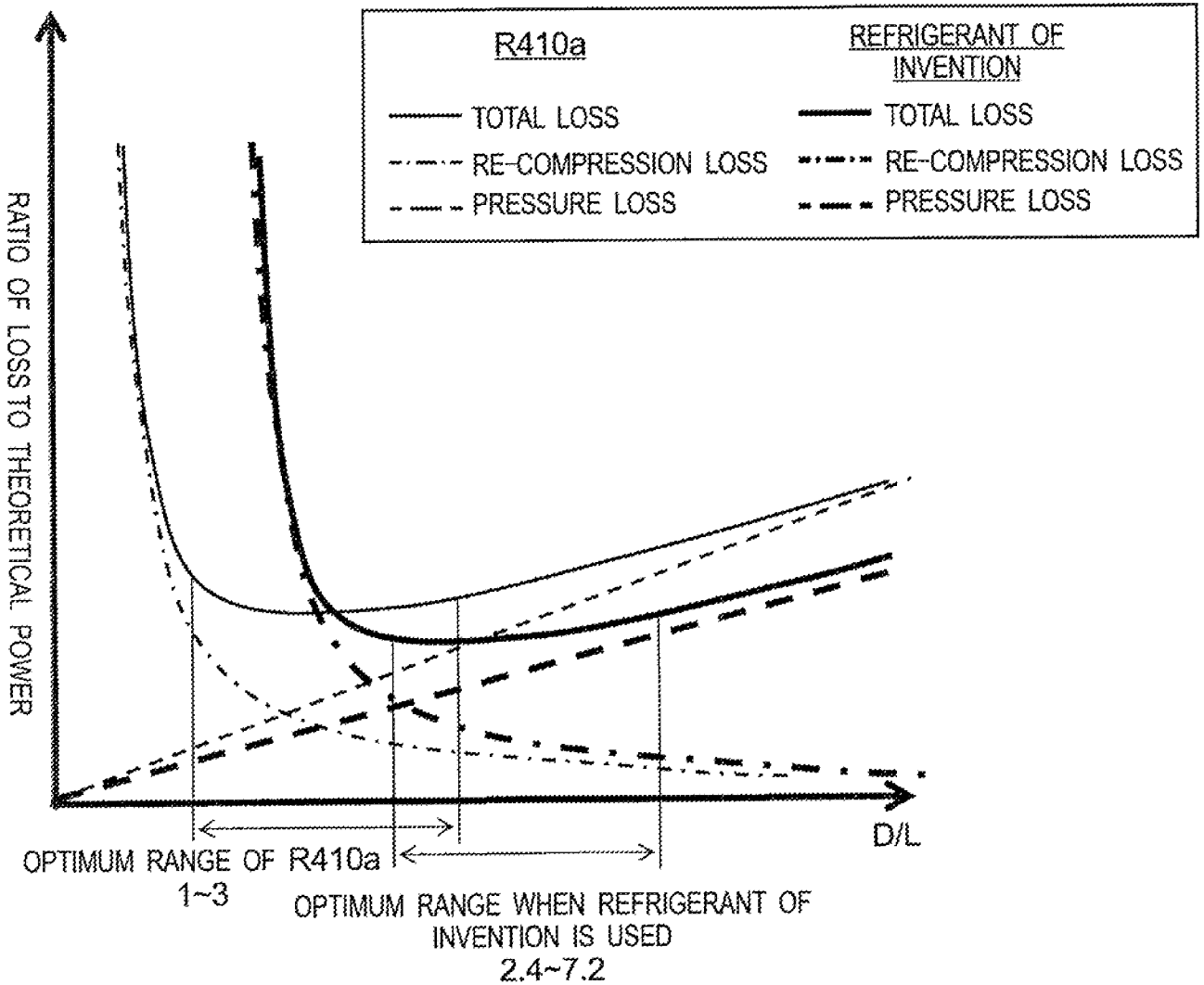
FIG. 6 is a graph indicating details of losses in bypass holes in the first embodiment and in the second embodiment of the present invention.

FIG. 6 is a graph indicating details of the losses in the bypass holes 68 in the first embodiment and in the second embodiment of the present invention. A horizontal axis indicates D/L and a vertical axis indicates a ratio of the losses to a theoretical power loss. A solid line indicates a total loss in the bypass holes 68, a single-dotted chain line indicates the re-expansion loss, a dotted line indicates a pressure loss, a thin line indicates the R410A refrigerant, and a thick line indicates the refrigerant employed in the scroll compressor according to the present invention (hereinafter referred to as the "refrigerant of the present invention"). As shown in FIG. 6, an aspect ratio D/L of the bypass holes 68 of the conventional compressor designed for the R410A refrigerant ranges from about 1 to about 3 and, in this range, a balance between the efficiency and the reliability of the compressor is ensured.

On the other hand, in the case of the refrigerant of the present invention, if the volume V of the bypass holes 68 is increased to 250% to thereby make a ratio of the re-expansion loss to a theoretical power equal to that of the R410A refrigerant, a ratio of the pressure loss to the theoretical power as indicated by the dotted line can be reduced, considering the fact that the re-expansion loss can be maintained the same even if the length L of the bypass holes 68 is reduced to 75% and the diameter D of the bypass holes 68 is increased to 180%. Specifically, if a mass flow of the refrigerant of the present invention passing through the bypass holes 68 is the same as that of the R410A refrigerant, a volumetric flow obtained by dividing the mass flow by a density increases to 250% because the density of the refrigerant of the present invention is about 40% of that of the R410A refrigerant. On the other hand, a sectional area of the bypass holes 68 increases to about 330% because the diameter D of the bypass holes 68 can be increased to 180%. Accordingly, the pressure loss can be reduced by reducing a speed of the refrigerant passing through the bypass holes 68, which speed is obtained by dividing the volumetric volume by the sectional area.

As shown in FIG. 6, the aspect ratio D/L of the bypass holes 68 of the conventional compressor designed for the R410A refrigerant ranges from about 1 to about 3 in view of the reliability when an increased load is applied and, accordingly, when the refrigerant of the present invention is used, the aspect ratio D/L of the bypass holes 68 is increased to about 240% so as to be in the range of 2.4-7.2, thereby making it possible to enhance the efficiency due to minimization of the pressure loss and the re-compression loss in the bypass holes 68 and maintain the rigidity to keep deformation of the stationary scroll 12 within an allowable range. As a result, a balance between the efficiency and the reliability of the compressor can be achieved.

It is to be noted that of the various embodiments referred to above, any combination of them can produce effects of respective embodiments.

Although the present invention has been fully described by way of preferred embodiments with reference to the accompanying drawings, it is to be noted here that various changes and modifications will be apparent to those skilled in the art. Therefore, unless such changes and modifications otherwise depart from the scope of the present invention as set forth in the appended claims, they should be construed as being included therein.

The contents of a specification, drawings and claims of a Japanese patent application No. 2010-155638 filed Jul. 8, 2010 are herein expressly incorporated by reference in their entirety.

INDUSTRIAL APPLICABILITY

As described above, even if a single-component refrigerant mainly comprising hydrofluoroolefin having a carbon-carbon double bond or a mixture refrigerant containing this refrigerant is used as a refrigerant, the scroll compressor according to the present invention can enhance the efficiency and the reliability. Accordingly, the rotary compressor according to the present invention is applicable to air conditioners, heat pump water heaters, refrigerator-freezers, dehumidifiers or the like.

The invention claimed is:

1. A scroll compressor employing therein a single-component refrigerant mainly comprising hydrofluoroolefin having a carbon-carbon double bond or a mixture refrigerant containing this refrigerant, the scroll compressor comprising:

a stationary scroll having a stationary end plate and a stationary scroll wrap rising up from the stationary end plate, the stationary end plate having a discharge port defined therein at a central portion thereof so as to open into a discharge chamber; and an orbiting scroll having an orbiting end plate and an orbiting scroll wrap rising up from the orbiting end plate, the orbiting scroll being held in engagement with the stationary scroll to define a plurality of compression chambers therebetween, wherein the stationary end plate has a plurality of bypass holes defined therein to allow the compression chambers to communicate with the discharge chamber before the compression chambers communicate with the discharge port, a check valve is provided on at least one of the bypass holes to allow the refrigerant to flow from the compression chambers to the discharge chamber, and at least one of the bypass holes is a circular communication hole having a diameter D, a length L in a thickness direction of the stationary end plate, and a ratio D/L that ranges from 2.4 to 7.2.

2. The scroll compressor according to claim 1, wherein at least one of the bypass holes is formed at a position that allows the at least one bypass hole to open into only one of a first compression chamber formed on an outer side of the orbiting scroll wrap and a second compression chamber formed on an inner side of the orbiting scroll wrap.

3. The scroll compressor according to claim 1, wherein at least one of the bypass holes is formed at a position that allows the at least one bypass hole to open into both of a first compression chamber formed on an outer side of the orbiting scroll wrap and a second compression chamber formed on an inner side of the orbiting scroll wrap, the at least one bypass hole having a shape and a size that do not allow the at least one bypass hole to simultaneously open into the first compression chamber and the second compression chamber.

4. The scroll compressor according to claim 1, wherein the check valve comprises a reed valve mounted on a surface of the stationary end plate.

5. The scroll compressor according to claim 1, wherein a refrigerant mainly comprising hydrofluoroolefin having a carbon-carbon double bond or a mixture refrigerant containing this refrigerant and mixed with hydrofluorocarbon having no double bonds is used.

6. The scroll compressor according to claim 1, wherein a mixture refrigerant comprising tetrafluoropropene or trifluoropropene as a hydrofluoroolefin and difluoromethane as a hydrofluorocarbon is used.

7. The scroll compressor according to claim 1, wherein a mixture refrigerant comprising tetrafluoropropene or trifluoropropene as a hydrofluoroolefin and pentafluoroethane as a hydrofluorocarbon is used.

* * * * *